United States Patent [19]

Hoffman et al.

[11] 4,004,397

[45] Jan. 25, 1977

[54] APPARATUS AND PROCESS FOR MAKING DISPOSABLE PACKET ASSEMBLIES

[75] Inventors: Louis S. Hoffman, Morristown, N.J.; Navinchandra J. Patel, Billerica; George A. Flibotte, Tewksbury, both of Mass.

[73] Assignee: Diamond Crystal Salt Company, St. Clair, Mich.

[22] Filed: Oct. 24, 1975

[21] Appl. No.: 625,524

[52] U.S. Cl. ..... 53/29; 53/183

[51] Int. Cl.[2] ..... B65B 1/02; B65B 9/04

[58] Field of Search ..... 53/28, 29, 30 R, 180 R, 53/183, 184 R, 185, 187

[56] References Cited

UNITED STATES PATENTS 2,649,673 8/1953 Bartelt ..... 53/180

3,199,551 8/1965 Hall et al. ..... 53/183 X

*Primary Examiner*—Robert Louis Spruill

*Attorney, Agent, or Firm*—Harness, Dickey & Pierce

[57] ABSTRACT

An apparatus and process for making assemblies comprised of a plurality of interconnected disposable packets containing a selected combination of condiments or the like. In accordance with the apparatus and process aspects of this invention, the packet assemblies are produced from a web comprised of two opposed strips which are bonded together to form a plurality of individual cavities which are sequentially filled and sealed with the desired variety of condiments, whereafter the web is severed into sections comprised of the interconnected disposable packet assemblies.

10 Claims, 11 Drawing Figures

APPARATUS AND PROCESS FOR MAKING DISPOSABLE PACKET ASSEMBLIES

BACKGROUND OF THE INVENTION

Disposable dispensing packets or portion control items are in widespread use in food service systems such as restaurants, fast-food and carry-out establishments, hospitals, institutions, and the like. Such disposable dispensing packets are constructed of a low-cost material, such as paper and/or plastic, and contain a normal individual serving of condiments, such as salt, pepper, sugar, sugar substitute, salt substitute or the like. The particular number and combination of packets will vary from meal to meal and whether or not an individual is under special diet restrictions, such as patients in hospitals or institutions, whereby the condiments placed on their meal tray are controlled by the particular dietary program prescribed. For example, patients in hospitals and other institutions may be subject to dietary programs which provide a salt-free or sugar-free diet in lieu of normal diets, whereby salt substitutes and sugar substitutes, respectively, are placed on the patient's tray. To facilitate the dispensing of appropriate diets for various patients, color-coding systems have been adopted for each particular diet to increase the speed and efficiency in meal services as well as assuring the correct diet for each individual.

It has been customary to assemble the desired number and combination of disposable packets in an envelope which may additionally contain supplemental eating utensils, such as plastic forks, knives, spoons, napkins, drinking tubes, and the like, to facilitate handling by food service personnel. The envelopes ordinarily are of a transparent material, such as cellophane, to enable visual inspection of the contents of each envelope.

While dispensing systems of the foregoing type have found widespread acceptance in many meal service operations, there has been an increasing need for assemblies of portion control items which still further facilitate meal service handling operations, which are of relatively low cost, and which assure that the proper type and combination of disposable packets have been dispensed. The apparatus and process of the present invention overcomes many of the disadvantages of prior art systems in providing an assembly of interconnected packets which can be quickly and simply separated by the ultimate user at the time of use for dispensing the contents thereof. The interconnected packet assembly further assures the correct combination of packets for a particular meal or dietary program, facilitates handling due to its unitary structure and further prevents inadvertent loss of individual packets during the food serving operation. The interconnected nature of the packet assembly obviates the necessity, in most instances, of employing a separate envelope and the manner of producing the packets provides for further economies due to its simplicity, adaptation to high-speed mass production techniques, efficiency and optimum utilization of raw materials.

SUMMARY OF THE INVENTION

The benefits and advantages of the present invention are achieved, in accordance with its apparatus aspects, by a mechanism which is adapted to form and longitudinally advance a web comprised of opposed strips which are bonded in face-to-face relationship along transversely extending bands disposed at fixed longitudinally spaced intervals defining a plurality of cavities which are selectively filled with controlled amounts of materials to be dispensed and are subsequently sealed, forming a plurality of interconnected packets.

In accordance with one embodiment of the present invention, the lateral edge of alternating ones of the cavities are sealed, whereafter the cavities are filled and the opposite lateral edge is sealed, followed by a repetition of the foregoing sequence as the web travels at high speed through a series of filling and sealing stations until all of the cavities have been filled, and the web thereafter is severed into sections comprising a plurality of interconnected packets containing a selected combination of condiments such as, for example, salt, pepper, and sugar. In accordance with an alternative embodiment, the longitudinal web incorporating a plurality of transversely spaced cavities is sealed along a continuous band extending parallel and intermediate to the lateral edges of the web, forming a plurality of opposed open-ended cavities. The web is oriented so as to effect a filling of the cavities along one side, which are thereafter sealed and the web is inverted to facilitate a filling of the cavities along the opposite row, whereafter the lateral edge is again sealed, forming a plurality of filled packets disposed in side-by-side relationship, each containing a different condiment. The web subsequently is severed into sections comprising the two interconnected packets.

In accordance with still another embodiment of the present invention, the longitudinally extending web incorporating a plurality of transversely extending cavities is first sealed along the lower lateral edge thereof, whereafter a first condiment is introduced to effect a controlled filling of a portion of the lower portion of the cavity, followed by a sealing of the cavity at a position intermediate of the lateral edges of the web. Thereafter, a second condiment is introduced into the cavities to effect a further partial filling thereof, followed by a second intermediate seal, after which a third filling and sealing operation is performed such that the resultant web comprises interconnected sections of three transversely extending packets, each containing a selected different condiment. The web subsequently is severed into the individual sections comprising three interconnected packets.

In accordance with the preferred embodiments of the present invention, the web is oriented in an upright position with the open ends of the cavities disposed upwardly for receiving the filler material as the web passes through a curtainous stream of the particulated fill during its travel through a filling station. The apparatus also preferably incorporates means for scoring, perforating, or otherwise structurally weakening the web along the band between interconnected packets of each section to facilitate a separation of the packet at the time of ultimate use. It is also contemplated that combinations of the several apparatus embodiments can be employed to make assemblies of interconnected packets of different controlled sizes, shapes and combinations and variations thereof consistent with the intended end use of the packet assembly.

In accordance with its process aspects, the present invention is directed to a method by which a continuous longitudinally extending web comprised of opposed strips is transversely bonded in face-to-face relationship at longitudinally spaced intervals, forming a plurality of cavities which are selectively filled and sequentially sealed to form a plurality of packets which subsequently are severed into sections or packet assemblies comprising a preselected combination of interconnected packets containing different condiments.

Further benefits and advantages of the present invention will become apparent upon a reading of the description of the preferred embodiments taken in conjunction with the accompanying drawings.

DESCRIPTION OF THE PREFERRED EMBODIMENTS

Figure 1:
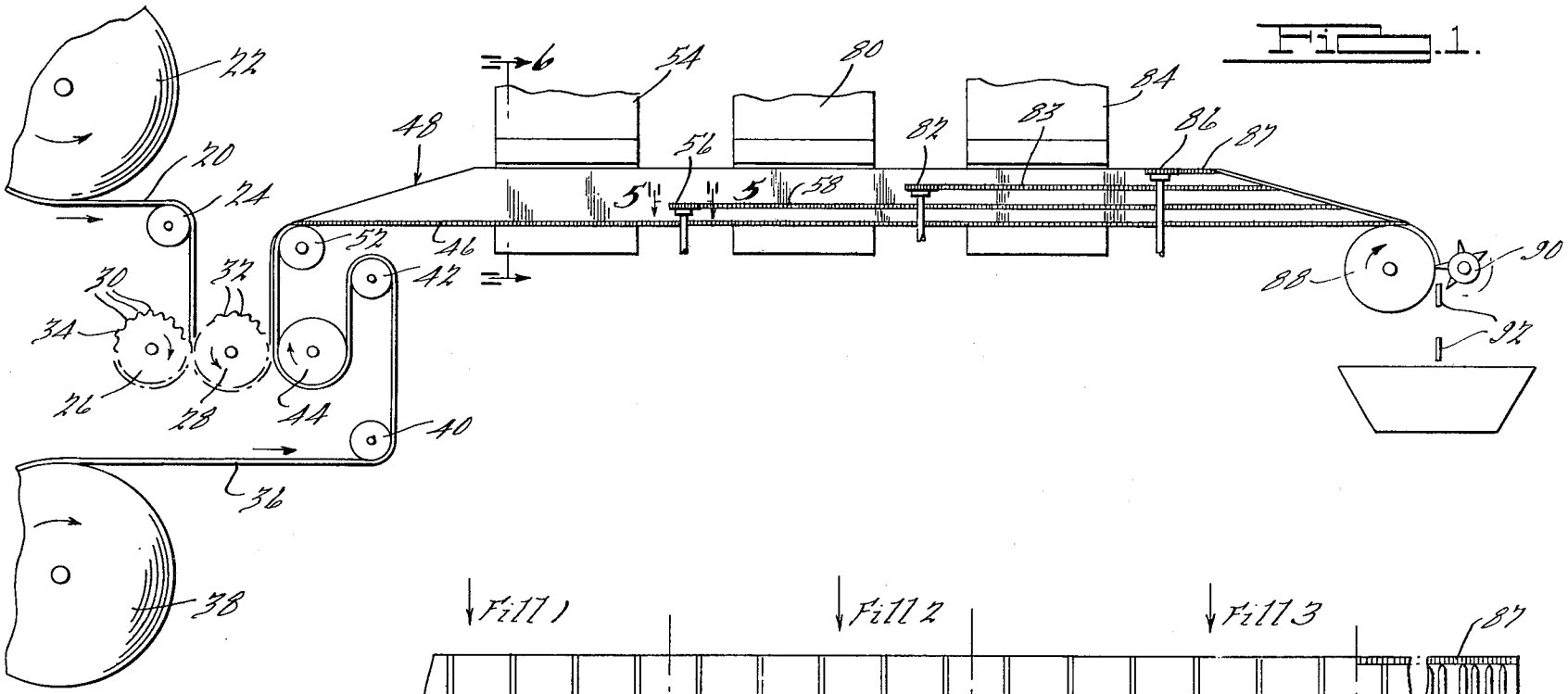
FIG. 1 comprises a side elevational view, partly schematic, illustrating the important elements of the web forming, filling and sealing apparatus in accordance with one of the embodiments of the present invention.

Referring now in detail to the drawings, an apparatus is shown in FIG. 1 which comprises an adaptation of the apparatus as disclosed in U.S. Pat. No. 2,826,020, by which two strips of material, such as paper, for example, are united, forming a web incorporating a plurality of corrugations therealong. The apparatus of the present invention also preferably incorporates a web-forming mechanism, whereby the cavity of each packet is defined by a plurality of flutes or corrugations disposed in side-by-side relationship and which are separated from the adjacent packet by means of a band in which the two opposed strips are tenaciously bonded in face-to-face relationship. It is also contemplated, however, that the web can be formed with single cavities or pouches which are filled with the particulated condiments to be dispensed.

As shown in FIG. 1, a continuous strip 20 is supplied from a feed roll 22 and extends over a guide roll 24 which is disposed with its periphery in axial alignment with the bight portion of a pair of cooperating forming rolls 26, 28. The forming rolls 26, 28 are mounted for rotation about horizontal parallel axes and the peripheries thereof are formed with conjugate projections 3 and recesses 32 which are substantially semi-circular in cross section to impart a corrugated or fluted pattern to the strip. In the specific embodiment illustrated, four projections and recesses are disposed in series separated by a flat section 34 so as to form a transverse band defining a seal between adjacent packets upon being united with a second strip 36.

As shown, the second strip 36 is unwound from a feed roll 38 and extends around a guide roll 40 and a dancer roll 42 for applying appropriate tension thereto and thereafter passes around a roll 44 which is driven in synchronization with the forming roll 28. The first and second strips 20, 36 are united at the bight portion of rolls 28, 44, and are tenaciously bonded to each other such as by means of suitable adhesive, or preferably, by a heat sealing of the two strips together in face-to-face relationship. In accordance with a preferred embodiment, the mating faces of the two continuous strips are provided with a thin coating of a suitable thermoplastic resin, such as polyethylene or polyvinyl chloride, for example, which upon compression while in contact with heated rolls 28, 44, effects a heat softening thereof, providing mutual adherence between the strips.

Figure 2:
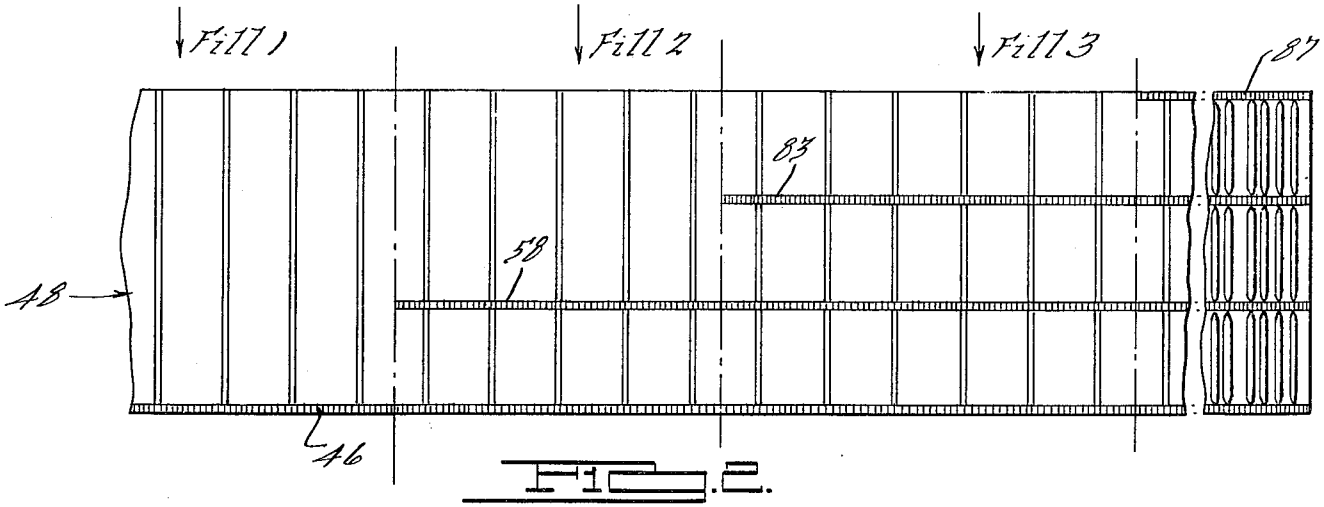
FIG. 2 is a fragmentary side elevational view, partly schematic, of a longitudinal web illustrating the filling and sealing sequence in accordance with the apparatus illustrated in FIG. 1.
Figure 4:
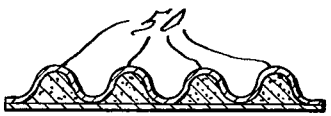
FIG. 4 is a transverse vertical sectional view through the packet assembly shown in FIG. 3 and taken along the line 4—4 thereof.

In the specific embodiment illustrated in FIG. 1, the rolls 28 and 44 are also provided with crimping flanges along one of the mating side edges thereof (not shown) for compressing and forming a sealed edge 46 extending in a continuous manner along one lateral edge of the web, as may be best seen in FIG. 2. The united strips forming a continuous web 48 having a plurality of longitudinally spaced cavities at fixed longitudinal intervals therealong, each collectively comprised of four flutes 50, as best seen in FIG. 4, is advanced upon emergence from the forming roll 28 and roll 44 over a guide roll 52 and thereafter is oriented into a substantially upright position with the open ends of the flutes or cavities disposed upwardly. The web thereafter is guidably advanced through a first filling station, indicated at 54, in which a controlled quantity of a selected material is introduced into the lower portion of each of the cavities, which in the specific embodiment illustrated, effects a filling of approximately the lower third thereof. Upon emergence from the filling station 54, the web is heat sealed by a crimping wheel mechanism 56, forming a continuous longitudinally extending sealing band 58 disposed parallel to the lower sealed edge 46 and effecting a sealing of the contents therein, forming a first row of packets. The settling and packing of the pulverant material, such as sugar or salt, for example, and a purging of the upper portion of the cavity side walls is facilitated by subjecting the web to a high frequency vibration during the filling operation, and upon emergence from the filling station prior to the sealing operation.

Figure 6:
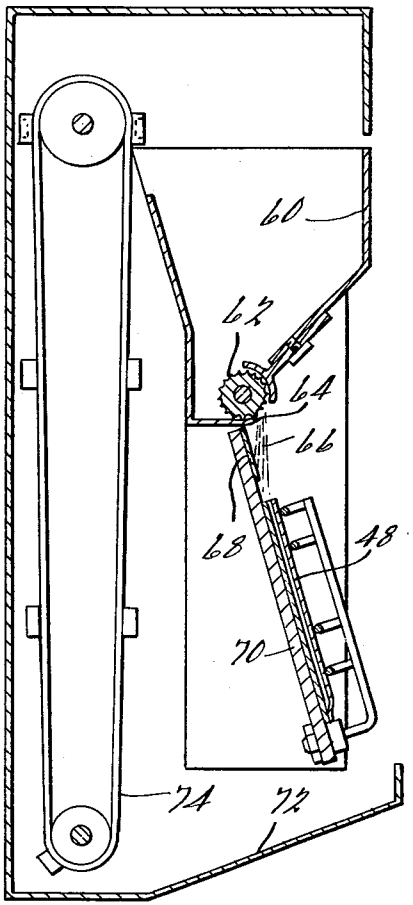
FIG. 6 is a transverse vertical sectional view of the apparatus shown in FIG. 1 and taken substantially along the line 6—6 thereof.

The filling mechanism preferably is of a construction as disclosed in U.S. Pat. No. 3,199,551, granted Aug. 10, 1965 for "Apparatus for Filling Packages", which is assigned to the same assignee as the present invention. Reference is made to the aforementioned patent for further details of the filling mechanism, the contents of which are incorporated herein by reference. Suffice it to say, the filling mechanism as best seen in FIG. 6 comprises a hopper 60 provided with a fluted rotatably driven feed shaft 62 in the base thereof, which is disposed in longitudinal alignment and closing relationship in an elongated outlet 64 in the base of the hopper. In response to rotation of the feed shaft 62, a curtainous stream indicated at 66 in FIG. 6 of the particulated filler material is formed which falls downwardly and impinges upon a shield 68 which directs the material into the open upper ends of the cavities in the web 48. The web itself is guidably supported in a channel 70 for travel in spaced parallel alignment beneath the filler mechanism. The material which does not enter the cavities of the web is recovered in a trough 72 and is recycled by means of a suitable bucket conveyor 74 into the upper end of the hopper 60.

The quantity of particulated material introduced into the lower portion of the cavities is controlled by virtue of the speed of rotation of the feed shaft 62, the longitudinal speed of travel of the web and the length of the elongated outlet in the base of the hopper. In accordance with this relationship, the filling operation is performed to introduce a quantity of a first material into the cavities corresponding to a normal serving.

Figure 5:
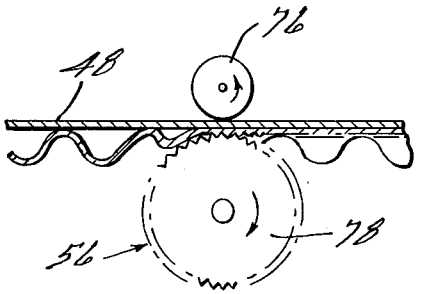
FIG. 5 is a fragmentary horizontal sectional view of a sealing assembly employed in the apparatus shown in FIG. 1 and taken along the line 5—5 thereof.

The heat sealing and crimping wheel mechanism 56, as best seen in FIG. 5, comprises a back-up roll 76 and a crimping roll 78 which are preferably heated and are disposed so as to effect a flattening and crimp heat sealing of the fluted portion of the web at a position above the contents in the cavities, forming the longitudinally extending sealing band 58.

Upon emergence from the crimping wheel mechanism 56, the continuous web enters a second filling station 80 in which a second material is introduced into the open upper ends of the cavities in the same manner as in the first filling station, whereafter a second crimping wheel mechanism 82 effects a sealing of the contents therein along a sealing band 83, forming a second row of packets. As before, a purging of the walls of the upper portion of the cavities of the filled material is effected by subjecting the web to a high frequency vibration to facilitate a settling of the particulated filler material.

Figure 3:
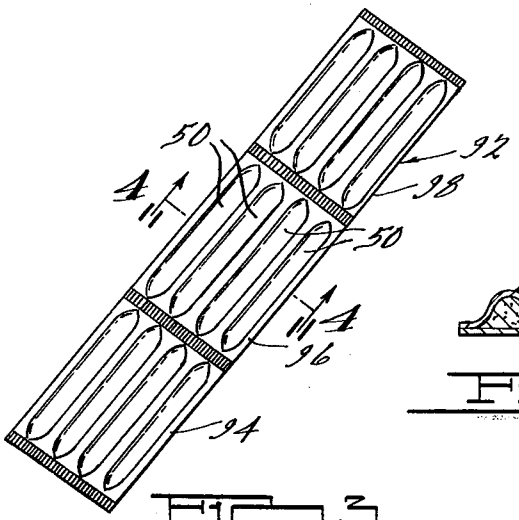
FIG. 3 is a plan view of a packet assembly comprising three interconnected packets made in accordance with the arrangements shown in FIGS. 1 and 2.

Upon emergence from the second crimping wheel mechanism 82, the web passes into a third filling station 84, wherein a third filler material is introduced in the same manner as previously described, whereafter the upper lateral edge of the web is heat sealed by a third crimping wheel mechanism 86 along a sealing band 87. The filled and sealed web comprising three rows of transversely spaced packets is thereafter reoriented into a horizontal position and passes over a back-up roll 88 and between a cutter roll 90, whereby the web is severed substantially along the midpoint of the transverse seal bands into sections comprising a packet assembly 92, as best seen in FIG. 3, comprising three interconnected packets 94, 96 and 98. In accordance with a preferred embodiment of the apparatus comprising the present invention, the crimping wheel mechanisms 56 and 82 employed to apply the intermediate longitudinally extending sealing bands 58 and 83 are further provided with perforating means to effect a structural weakening of the crimped and sealed band separating adjoining packets to facilitate the separation of the interconnected packets into their individual components at the time of ultimate use.

The filling and sealing sequence is schematically illustrated in FIG. 2, whereby the packet assembly 92 is produced which typically may contain individual servings of sugar, salt and pepper in three sealed interconnected packets. It will be appreciated that the arrangement as illustrated in FIGS. 1–6 is also applicable for producing webs comprised of only two rows of packets, as well as webs containing four or more rows, whereby the resultant packet assembly contains the desired number and quantity of condiments. It will also be appreciated that the transverse width of the packets in the individual rows can be varied to accommodate greater and lesser portions of certain condiments consistent with the quantities required for a normal serving.

Figure 7:
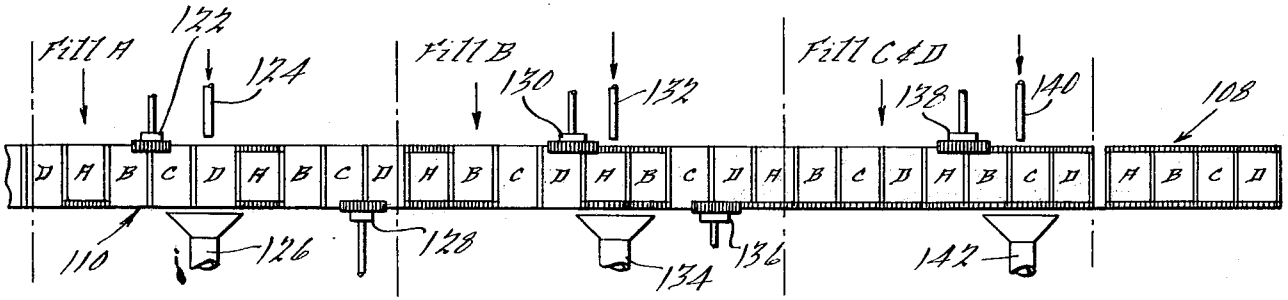
FIG. 7 is a fragmentary side elevational view, partly schematic, illustrating a filling and sealing sequence of a longitudinally moving web in accordance with an alternative embodiment of the present invention.
Figure 9:
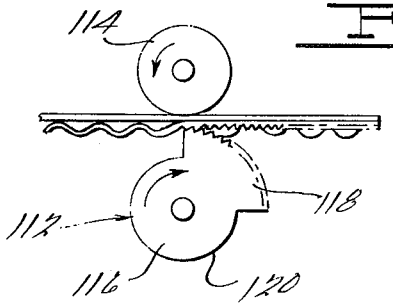
FIG. 9 is a fragmentary plan view of a segmented sealing mechanism employed in accordance with the arrangement illustrated in FIG. 7.
Figure 8:
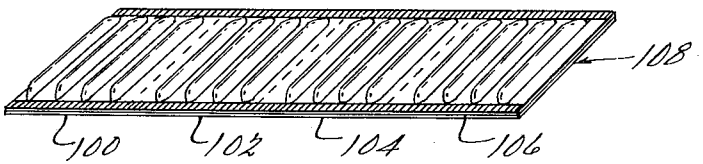
FIG. 8 is a perspective view of a packet assembly made in accordance with the arrangement shown in FIG. 7.

Referring now in detail to FIGS. 7–9, an alternative embodiment of an apparatus for producing interconnected packet assemblies is illustrated which is comprised of four packets 100, 102, 104 and 106, interconnected along their transverse edges into a packet assembly 108. A longitudinally extending web 110 containing longitudinally spaced cavities which preferably are in the form of a plurality of flutes is produced in accordance with the same arrangement as previously described in connection with FIG. 1. The flutes extend transversely of the web and are open at both ends thereof. The web is oriented in a substantially upright position in a manner as previously described and the lower laterally extending edge of alternate ones of the cavities at fixed spaced intervals are sealed employing a segmented crimping wheel mechanism 112 as shown in FIG. 9. As shown, the crimping wheel assembly includes a backing roll 114 and a crimping roll 116, the periphery of which is provided with a crimping segment 118 of a circumferential length corresponding to the longitudinal width of a packet. The remaining periphery of the crimping roll is recessed along the circumferential segment, indicated at 120, so as to provide an intermittent heat crimp sealing of the web at fixed longitudinally spaced intervals which in the specific embodiment shown, effects a sealing of the lower edges of the cavities indicated by the letter A in FIG. 7. It is also contemplated that the forming roll 28 and roll 44 (FIG. 1) can be provided with a peripheral segmented crimping portion to effect an intermittent sealing of one of the lateral edges of the web corresponding to the longitudinal width of the cavities A.

The web, as shown in FIG. 7, is thereafter advanced in the same manner as previously described in FIG. 1 beneath a first filling station in which the cavities designated by the letter A are filled with a desired condiment, and wherein the material passes through the cavities B, C and D, which remain open at their lower ends. Upon passing the first filler mechanism, the upper portion of the cavities A are sealed by a segmented crimping wheel mechanism, indicated fragmentarily at 122, of a type similar to that shown in FIG. 9, producing a sealed packet. After passing beyond the crimping mechanism 122, the web is advanced between an air jet nozzle 124 to effect a purging of the interiors of the open cavities and the residual condiments removed are recovered by a suction nozzle 126 disposed immediately adjacent to the lower edge of the web and in substantial alignment with the nozzle 124. The recovered condiments are recycled to the first filler mechanism.

As the web is advanced, it passes through a second segmented crimping wheel mechanism 128 which effects a heat sealing of the lower lateral edge of cavities B, whereupon the web passes beneath a second filler apparatus and thereafter a crimping wheel mechanism 130, which effects a sealing of the cavities B and the contents therein. The web is again subjected to a purging of the open-ended cavities by means of a nozzle 132 and suction nozzle 134, whereafter the web passes through still another crimping wheel mechanism 136, which effects a heat sealing of the lower lateral edges of cavities C and D. The simultaneous sealing of two cavities is typical of a situation in which two adjacent packets are to be filled with the same material, such as, for example, to provide a double sugar packet in the resultant packet assembly. Upon passing beyond the crimping wheel mechanism 136, the web passes beneath a third filling station in which cavities C and D are filled, whereafter the upper lateral edges are sealed by a crimping wheel mechanism 138 and any residual material remaining on the outer surfaces of the web are removed by an air nozzle 140 and suction nozzle 142 in a manner as previously described. The resultant filled web thereafter is severed in accordance with the cutter arrangement as illustrated on the right-hand end of FIG. 1 into the individual packet assemblies 108, as shown in FIG. 8.

Figure 10:
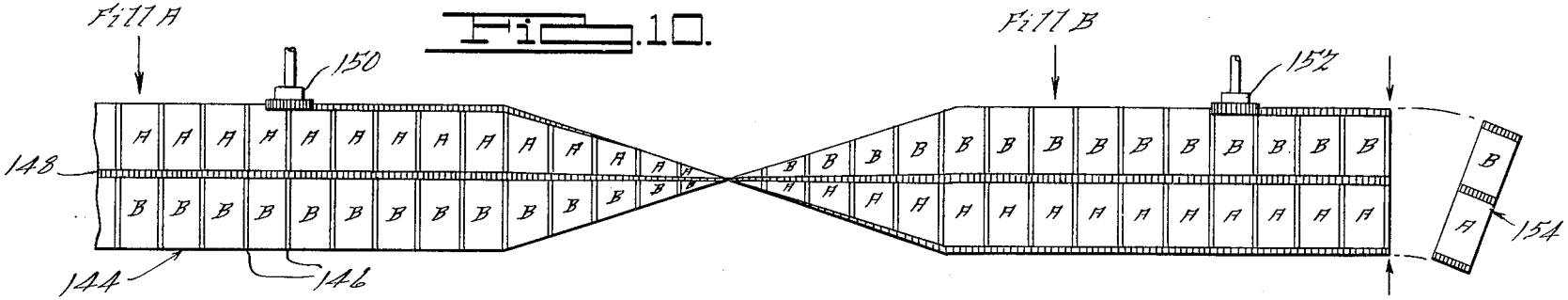
FIG. 10 is a fragmentary side elevational view, partly schematic, illustrating still another sequence for filling and sealing a longitudinally moving web forming packet assemblies.

FIG. 10 schematically illustrates still another alternative embodiment of the apparatus and process of the present invention, in which a continuous web 144 is formed employing the forming apparatus as previously described in connection with FIG. 1, comprising two strips bonded in face-to-face relationship along transverse bands 146 disposed at fixed longitudinally spaced intervals and along a longitudinally extending band 148 disposed intermediate of the open lateral edges of the web. The web, accordingly, comprises repeating transverse rows of cavities A and B which are sealed along their transverse edges and inner edge. The imposition of the longitudinal sealing band 148 can be achieved concurrently with the forming of the web on passing through the rolls 28, 44 (FIG. 1), wherein these two rolls are provided with a crimping flange intermediate of the side edges thereof. Alternatively, the longitudinal sealing band 148 can be applied employing a separate crimping wheel mechanism such as the mechanism 56 as shown in FIG. 5 disposed downstream of the forming roll mechanism.

The web 144 is first oriented in a substantially upright position such that the open ends of cavities A are oriented to receive a pulverant fill material upon passage beneath a first filling station provided with a filling mechanism such as shown in FIG. 6. Cavities A, as schematically illustrated in FIG. 10, accordingly, are filled with a controlled quantity of the material, whereafter the web passes between a crimping wheel mechanism 150, effecting a sealing of the upper lateral edge of the web, forming sealed packets A. The web thereafter is reoriented through an angularity of 180 degrees, such that the open ends of the cavities B are in position to receive a material being dispensed at a second filling station B, followed by a sealing of the upper lateral edge of the web by a crimping wheel assembly 152, producing a row of sealed packets B. The web subsequently is severed along substantially the midpoint of transverse bands 146, producing packet assemblies 154 comprising interconnected packets A and B.

Figure 11:
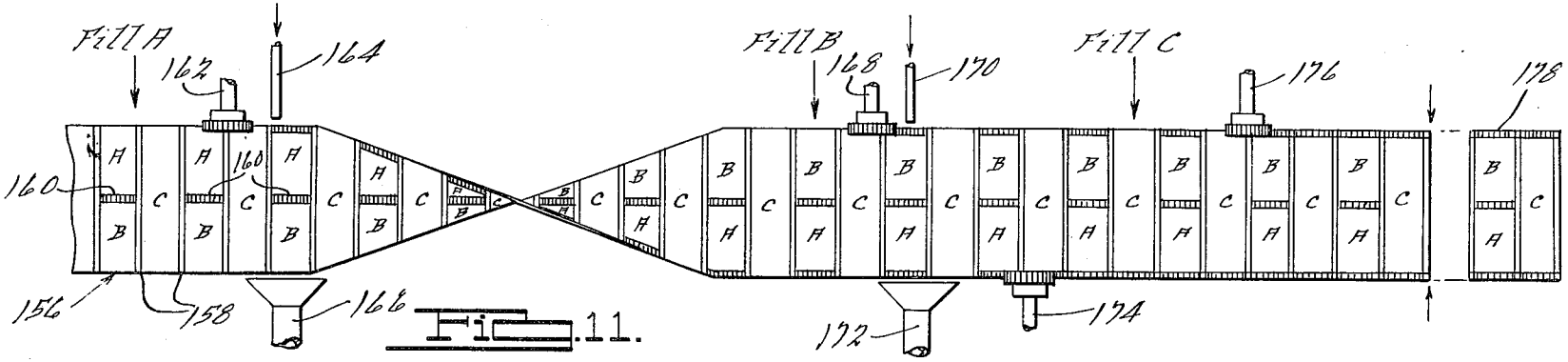
FIG. 11 is a fragmentary side elevational view, partly schematic, of another embodiment of a web filling and sealing sequence for making packet assemblies.

Still another embodiment of the apparatus and process of the present invention is illustrated schematically in FIG. 11, which comprises a modification of the embodiments as shown in FIGS. 7 and 10. In accordance with the arrangement of FIG. 11, a web 156 is formed in a manner as previously described comprising a plurality of transversely extending cavities disposed at longitudinally spaced fixed intervals which are separated by transverse sealing bands 158. An intermittent longitudinally extending intermediate sealing band 160 is applied to alternating ones of said cavities, dividing the same into two individual cavities A and B, which are open along the lateral edges of the web. Disposed therebetween are transverse cavities C, which extend across the entire width of the web and are open at each lateral edge thereof. The imposition of the intermediate sealing band 160 can be incorporated by a segmented crimping wheel assembly incorporated in the rolls 28, 40 (FIG. 1), or alternatively, by a separate segmented crimping wheel assembly of the type shown in FIG. 9.

In either event, the web is oriented in a substantially upright position and commencing at the left-hand end, as viewed in FIG. 11, passes beneath a filling station A, in which a pulverant material is introduced into cavities A, which are thereafter sealed by a crimping wheel assembly 162, forming sealed packets A. Thereafter, the web travels beneath an air nozzle 164 to effect a purging of the interior of cavities C, as well as the surfaces of the web of residual fill material, which is recovered by the suction nozzle 166 and recycled to filling station A. The web is thereafter inverted, as shown in FIG. 11, such that the open upper ends of cavities B are oriented to receive a pulverant material upon passing beneath filling station B. Cavities B are accordingly filled with an appropriate quantity of material and the upper lateral edges of the web are intermittently sealed by an intermittent crimping wheel assembly 168 adjacent to cavities B, forming sealed packets B. The web thereafter passes beneath an air nozzle 170 to effect a purging of the interiors of cavities C, as well as the surfaces of the web with the residual material recovered in a suction nozzle 172 for recirculation to filling station B.

The web thereafter, travelling toward the right as viewed in FIG. 11, passes between a crimping wheel assembly 174, which effects a sealing of the lower lateral edge of the web across cavities C, whereafter the web passes beneath a filling station C in which an appropriate quantity of material is introduced into the open ends of cavities C. Upon passage beyond the filling station C, the upper edge of the web is sealed by a crimping wheel assembly 176, forming packets C. The web, upon further travel, is severed at the cutting station into packet assemblies 178 comprising interconnected packets A, B and C.

While it will be apparent that the invention herein described is well calculated to achieve the benefits and advantages set forth above, it will be appreciated that the invention is susceptible to modification, variation and change without departing from the spirit thereof.

What is claimed is:

1. A process for making a repetitive series of interconnected dispensing packet assemblies which comprises the steps of forming and advancing a longitudinally extending web comprised of opposed strips bonded in face-to-face relationship along transversely extending bands disposed at longitudinally spaced intervals defining a plurality of alternating first and second cavities open along their lateral edges, sealing one lateral edge of the alternating said first cavities, filling the first cavities with a first material, sealing the opposite lateral edge of the filled said first cavities forming a plurality of first packets, sealing one lateral edge of said second cavities, filling said second cavities with a second material, sealing the opposite lateral edge of the filled said second cavities forming a plurality of second packets, and severing said web into sections each comprising an interconnected first and second packet.

2. A process for making a repetitive series of interconnected dispensing packet assemblies which comprises the steps of forming and advancing a longitudinally extending web comprised of opposed strips bonded in face-to-face relationship along transversely extending bands disposed at longitudinally spaced intervals and along a continuous longitudinally extending band disposed intermediate of the lateral edges of the web defining two rows consisting of a plurality of opposed cavities open along the lateral edges of said web, filling said cavities of one of the rows with a first material, sealing the lateral edges of the filled said cavities of said one row forming a plurality of first packets, filling said cavities of the other of the rows with a second material, sealing the lateral edges of the filled said cavities of said other row forming a plurality of second packets, and transversely severing said web along said transverse bands into sections each comprising an interconnected first and second packet.

3. A process for making a repetitive series of interconnected dispensing packet assemblies which comprises the steps of forming and advancing a longitudinally extending web comprised of opposed strips bonded in face-to-face relationship along transversely extending bands disposed at longitudinally spaced intervals defining a plurality of transverse cavities open along their lateral edges, sealing alternating ones of said transverse cavities along a longitudinal sealing band extending between the transverse bands at a position intermediate of the lateral edges of said web forming two rows of opposed intermediate cavities open along the lateral edges thereof, filling said intermediate cavities of one row with a first material, sealing the lateral edge of the filled said intermediate cavities of said one row forming a plurality of first packets, filling said intermediate cavities of the other row with a second material, sealing the lateral edge of the filled said intermediate cavities of said other row forming a plurality of second packets, sealing a lateral edge of the alternating said transverse cavities, filling said transverse cavities with a third material, sealing the opposite lateral edge of the filled said transverse cavities forming a plurality of third packets, and transversely severing said web along alternating ones of said transverse bands into sections each comprising an interconnected assembly of first, second and third packets.

4. An apparatus for making a repetitive series of interconnected dispensing packet assemblies comprising means for forming and advancing a longitudinally extending web comprised of opposed strips bonded in face-to-face relationship along transversely extending bands disposed at longitudinally spaced intervals defining a plurality of alternating first and second cavities open along their lateral edges, means for sealing one lateral edge of the alternating said first cavities, means for filling said first cavities with a first material, means for sealing the opposite lateral edge of the filled said first cavities forming a plurality of first packets, means for sealing one lateral edge of said second cavities, means for filling said second cavities with a second material, means for sealing the opposite lateral edge of the filled said second cavities forming a plurality of second packets, and means for severing said web along alternating ones of said transversely extending bands into sections each comprising an interconnected said first and said second packet.

5. An apparatus for making a repetitive series of interconnected dispensing packet assemblies comprising means for forming and advancing a longitudinally extending web comprised of opposed strips bonded in face-to-face relationship along transversely extending sealing bands disposed at longitudinally spaced intervals and along a continuous longitudinally extending sealing band disposed intermediate of the lateral edges of said web defining two rows each consisting of a plurality of cavities open along the lateral edges of said web, means for filling said cavities of one of the rows with a first material, means for sealing the lateral edge of the filled said cavities of said one row forming a plurality of first packets, means for filling said cavities of the other of the rows with a second material, means for sealing the lateral edges of the filled said cavities of said other row forming a plurality of second packets, and means for transversely severing said web along said transverse sealing bands into sections each comprising an interconnected first and second packet.

6. An apparatus for making a repetitive series of interconnected dispensing packet assemblies comprising means for forming and advancing a longitudinally extending web comprised of opposed strips bonded in face-to-face relationship along transversely extending sealing bands disposed at longitudinally spaced intervals defining a plurality of transverse cavities open along their lateral edges, means for sealing alternating ones of said transverse cavities along a longitudinal band extending between the transverse bands at a position intermediate of the lateral edges of said web forming two rows of opposed intermediate cavities open along the lateral edges thereof, means for filling said intermediate cavities of one row with a first material, means for sealing the lateral edge of the filled said intermediate cavities of said one row forming a plurality of first packets, means for filling said intermediate cavities of the other row with a second material, means for sealing the lateral edge of the filled said intermediate cavities of said other row forming a plurality of second packets, means for sealing a lateral edge of the alternating said transverse cavities, means for filling said transverse cavities with a third material, means for sealing the opposite lateral edge of the filled said transverse cavities forming a plurality of third packets, and means for transversely severing said web along alternating ones of said transverse sealing bands into sections each comprising interconnected first, second and third packets.

7. The apparatus as defined in claim 6, further including guide means for orienting said web such that the open end of said plurality of said cavities is disposed upwardly for receiving the material for filling said cavities.

8. The apparatus as defined in claim 6, wherein the several said means for sealing said cavities include heating means for heat sealing said opposed strips in face-to-face sealed relationship.

9. The apparatus as defined in claim 6, wherein said means for forming a longitudinally extending web includes means for forming a plurality of transversely extending flutes defining each of said cavities.

10. The apparatus as defined in claim 6, in which said means for introducing said first material and said second material into said cavities includes a hopper containing said material, said hopper formed with a longitudinally extending slot along the base thereof disposed substantially parallel to the direction of travel of said web, metering means in said slot for discharging a substantially continuous curtainous stream of said material from said hopper, and deflector means for deflecting said curtainous stream into the openings of said cavities to effect a filling thereof.

* * * * *